US005094362A

United States Patent [19]

Dickens

[11] Patent Number: 5,094,362

[45] Date of Patent: Mar. 10, 1992

[54] FLEXIBLE WALL TUBE KEY DISPENSER

[76] Inventor: James Dickens, 28 Westland St., Hartford, Conn. 06120

[21] Appl. No.: 375,733

[22] Filed: Jul. 5, 1989

[51] Int. Cl.[5] ..... B65D 35/32

[52] U.S. Cl. ..... 222/99

[58] Field of Search ..... 222/99

[56] References Cited

U.S. PATENT DOCUMENTS

| | | | |
|---|---|---|---|
| 2,035,713 | 3/1936 | McMakin | 222/99 |
| 2,054,990 | 9/1936 | Newton | 222/99 |
| 2,903,162 | 9/1959 | Regan | 222/99 |
| 4,352,441 | 10/1982 | Rosenlind et al. | 222/99 |

FOREIGN PATENT DOCUMENTS

| | | | |
|---|---|---|---|
| 1324161 | 7/1973 | United Kingdom | 222/99 |

*Primary Examiner*—Michael S. Huppert
*Assistant Examiner*—Gregory L. Huson
*Attorney, Agent, or Firm*—Fishman, Dionne & Cantor

[57] ABSTRACT

The present invention consists of a tube key dispenser (18) which comprises a key (12) and a locking bracket (10). The tube (14) to be dispensed is inserted between projecting arms (22) of the key (12), and, while holding a locking member (26) of the locking bracket (10) against the tube, the key head (20) is turned causing the substance in the tube (14) to be dispensed.

6 Claims, 2 Drawing Sheets

FLEXIBLE WALL TUBE KEY DISPENSER

BACKGROUND

1. Field of Invention

This invention relates to dispensers for flexible/collapsible wall tube containers and specifically to such dispensers which control the extrusion of viscous substances from such containers.

2. Description of Prior Art

Many types of collapsible tube containers are well known for containing fluid like substances. Thin walled metal containers are usually used for the containment of low viscosity substances, whereas containers made with resilient plastics are used for substances with relatively higher viscosity.

U.S. Pat. No. 3,628,696 to Duiker (1971) discloses a dispenser for flexible wall tube containers. The tube container is collapsed and wound upon a mandrel, and once the tube is collapsed the dispenser prevents the tube from unwinding or expanding. However, the device in Duiker is relatively complex and less economical from a manufacturing stand point.

Several types of dispensers for collapsible tube containers have been disclosed; for example U.S. Pat. No. 2,013,389 to Lovrich (1935), U.S. Pat. No. 1,669,247 to Johnson (1928), U.S. Pat. No. 1,797,727 to Spisa (1931), U.S. Pat. No. 1,973,543 Simon (1934), and U.S. Pat. No. 648,981 to Nelson (1900). However, these devices are relatively more expensive to manufacture since they fail to provide dispensers that one can make with one standard type of stock material. Also, by way of design, they require a relatively high amount of torque to be applied when winding the tubes during dispensing, thus requiring more work by the user.

OBJECTS AND ADVANTAGES

Accordingly, several objects and advantages of the present invention are:

(a) to provide a low cost, easy to manufacture flexible tube key dispenser.

(b) to provide a flexible tube key dispenser that will not slip off the tube, and when locked the tube will not unravel.

(c) to provide a flexible tube key dispenser that works with flexible wall tubes made of resilient plastics as well as tubes made of thin metal walls.

(d) to provide a flexible tube key dispenser that will not require a large amount of work to operate (i.e., a large amount of torque will not be required in order to wind the tube during dispensing).

(e) to provide a flexible tube key dispenser that can be used on many different tubes having a variety of sizes and containing a variety of substances, ranging from low viscosity substances to those having high viscosity.

(f) to provide a flexible tube key dispenser that requires only one standard stock material for its manufacture.

(g) to provide a flexible tube key dispenser that may be made of plastic, metal, or any other suitable resilient material.

(h) to provide a flexible tube key dispenser that is not restricted to dimensions having small tolerances, thus one dispenser can accommodate a large range of tube types and sizes.

Further objects and advantages will become apparent from a consideration of the ensuring description and drawings.

REFERENCE NUMERALS IN THE DRAWINGS

Figure 1:
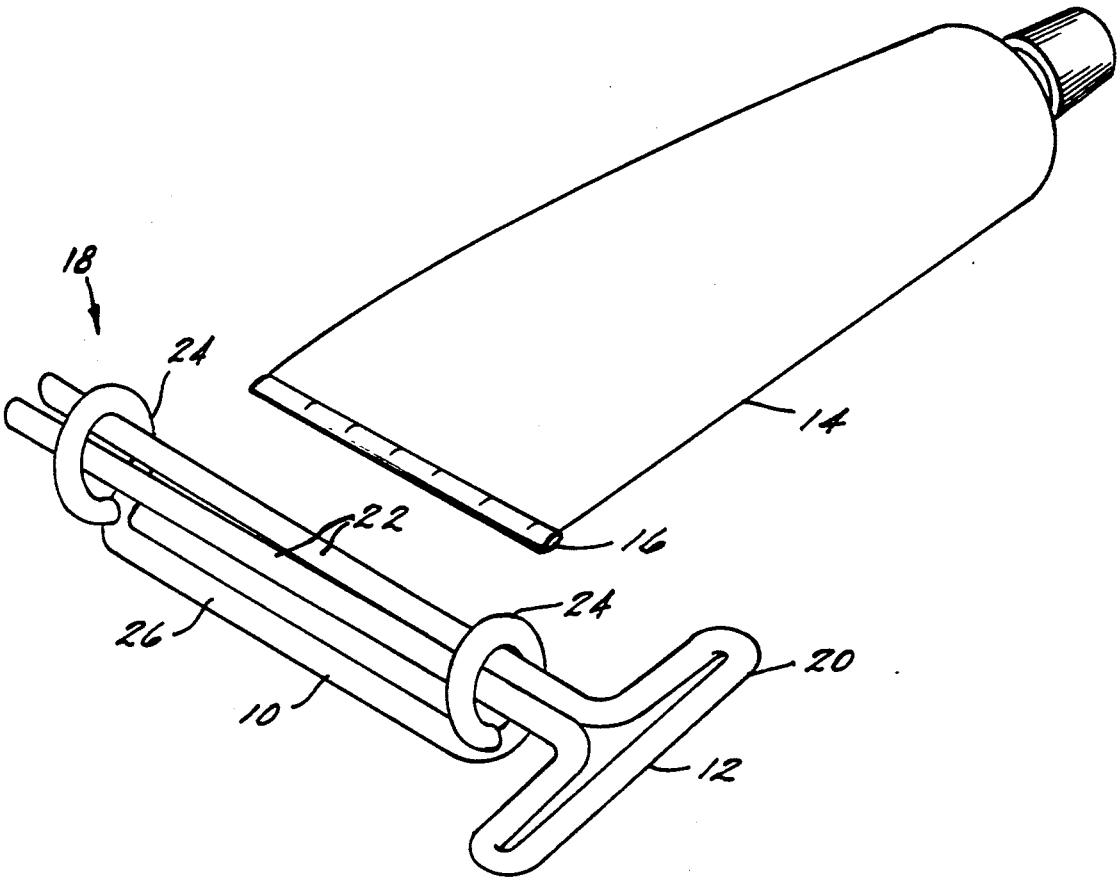
FIG. 1 shows a perspective view of a preferred embodiment of the present invention along side a collapsible wall tube.

10 locking element
20 key head
12 key head
22 outwardly projecting arms
14 flexible wall tube
24 latches
16 closed end of tube
26 locking member
18 tube key dispenser
28 direction arrow

DETAILED DESCRIPTION

FIG. 1 is a perspective view of the present invention showing a tube 14 and a tube key dispenser 18 which consists of a key 12 and a locking bracket 10. The key 12 comprises a head portion 20 and outwardly projecting arms 22. The locking bracket 10 comprises a longitudinal locking member 26 and two latches 24, one at each end of the longitudinal locking member 26. The latches 24 each form loops in a plane substantially perpendicular to the locking member 26, and function to attach or latch the locking bracket 10 to the key 12.

The tube key dispenser 18 of the present invention may be manufactured by cutting two pieces of standard resilient metal stock and making bends as shown in the figures or in other configurations, as are well known in the art, to produce the same overall result.

OPERATION

The operation of the present invention is described as follows with reference to FIGS. 2–4, 5A, and 5B.

Figure 4:
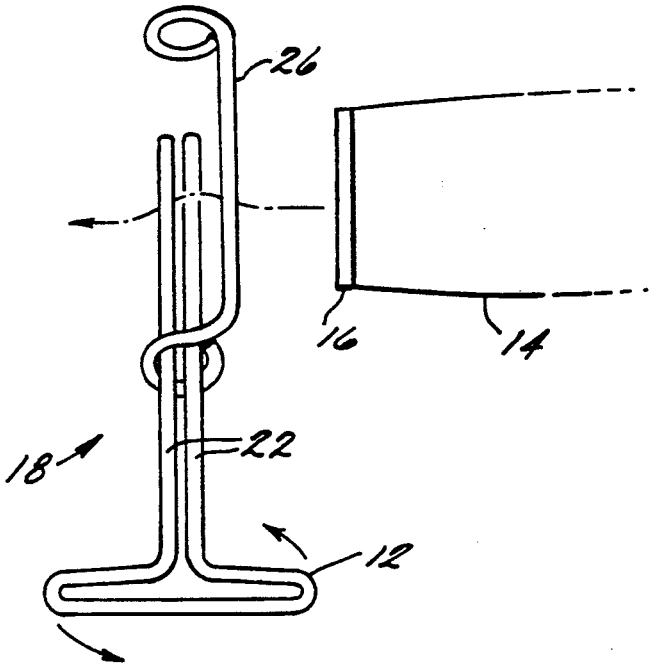
FIG. 4 shows the initial step of attaching the embodiment of the present invention to a tube.

Referring to FIG. 4, the closed end 16 is first inserted between arms 22 while the key 12 is only inserted through one of the latches 24, as shown. The arms 22 of key 12 are then fully inserted into the second of the two latches 24, thus completely assembling the tube key dispenser. Now, in order to commence dispensing of the medium inside of the tube 14, the key head 20 is turned counter clockwise while holding the locking member 26 against the tube as shown by arrow 28 in FIG. 2.

The pressure applied to the locking member 26 while holding the locking member against the tube 14 can be increased causing the tube 14 to be wound tighter around the key 12. If it is not necessary to wind the tube so tight, less pressure can be applied to the locking member 26 while turning the key head 20. This makes it easier to turn the key head.

Figure 2:
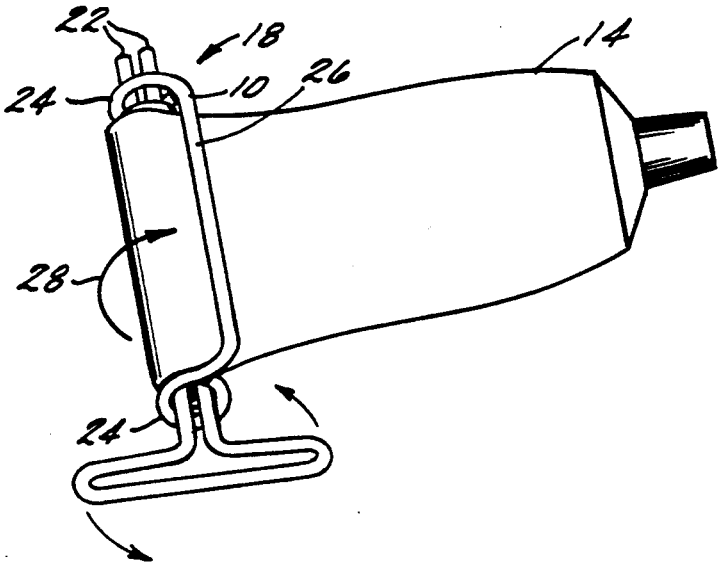
FIGS. 2 and 3 show alternative views of the preferred embodiment showing the tube key dispenser as it is being used with a tube.
Figure 3:
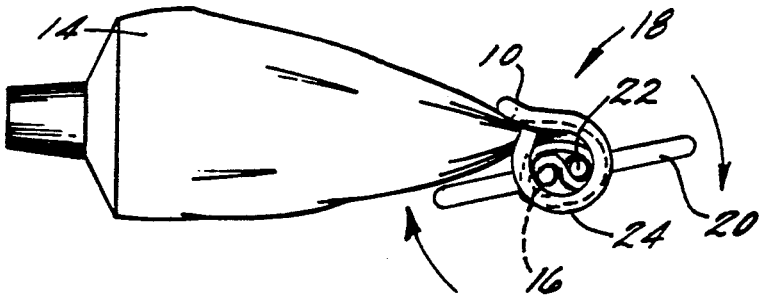

FIGS. 2 and 3 show a partially dispensed tube 14 in operation with the tube key dispenser 18. The locking member 26 serves to prevent the tube 14 from unravelling. Also, the latches 24 serve to prevent the dispenser 18 from slipping off the tube 14 by sufficiently clamping the projecting arms 22 and thus securing the tube end 16 between the projecting arms 22.

In order to lock the tube key dispenser 18 so that it does not unwind, the locking bracket 10 is rotated, as shown by the arrow 28 in FIG. 2, so as to abut the tube 14 with the locking member 26. In order to unlock the tube key dispenser 18, the locking bracket 10 is simply rotated in the opposite direction.

Figure 5A:
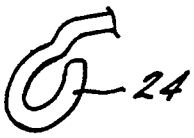
FIGS. 5A and 5B show two alternative embodiments of latches which enhance the locking feature of the present invention.
Figure 5B:
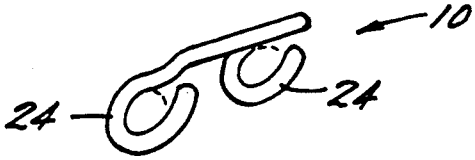

Referring to FIGS. 5A and 5B, the locking function of the locking bracket 10 can be enhanced by the shape of the latches 24. Although the latches are substantially formed as circular loops, unique variations in the shape of the latches 24, formed by (for example) making the loops slightly elliptical (see FIG. 5A) or tear drop shaped (see FIG. 5B), help hold the locking bracket 10 in the locked position by interacting with the projecting arms 22.

Accordingly, the reader will see that the tube key dispenser of the present invention provides an easily used, economical device which can be used to dispense many types and sizes of flexible wall containers. Furthermore, the tube key dispenser has the additional advantages that:

* it will not slip off the tube, and, when locked, the tube will not unravel.

* it provides a flexible tube key dispenser that works with any collapsible/flexible wall tube containers containing viscous materials.

* it is relatively easy to operate, requiring little strength on the part of the user.

* it can be made of plastic, metal, or any other suitable material.

* it requires only one type of standard stock for its manufacture.

Although the description above contains many specificities, these should not be construed as limiting the scope of the invention, but as merely providing illustrations of some of the presently preferred embodiments of this invention. For example, the latches can be circular, or they can have unique shapes other than those shown in FIGS. 5A and 5B.

Thus, the scope of the invention should be determined by the appended claims and their legal equivalents, rather than by the examples given.

What is claimed is:

1. A winding key for a flexible wall tube container, comprising:

a bracket, comprising:

a retainer bar longitudinally extending from a first end to an opposite second end, a pair of planar retaining loops, said loops extending perpendicularly from opposite ends of said bar and each of said loops having an inner surface defining a central opening, said central openings being in axial alignment with each other;

a pair of arms, extending parallel to each other and to the bar and extending through each of the central openings of the loops, for clamping an end of the container therebetween; and key means, secured to said arms, for rotating the pair of arms relative to the bracket to wind the flexible tube around said pair of arms.

2. The key of claim 1, wherein the arm and key means comprise a single continuous piece of formed metal rod.

3. The key of claim 1, wherein the bracket comprises a single continuous piece of formed metal rod.

4. The key of claim 1, wherein the inner surfaces of the loops define elliptically-shaped central openings.

5. The key of claim 1, wherein the inner surfaces of the loops define tear drop-shaped central openings.

6. The key of claim 1, wherein the inner surface of the loops define circular central openings.

* * * * *